US006339415B2

(12) United States Patent
Ishizuka

(10) Patent No.: US 6,339,415 B2
(45) Date of Patent: Jan. 15, 2002

(54) ELECTROLUMINESCENT DISPLAY AND DRIVE METHOD THEREFOR

(75) Inventor: Shinichi Ishizuka, Saitama-ken (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/296,545

(22) Filed: Apr. 22, 1999

(30) Foreign Application Priority Data

Apr. 22, 1998 (JP) ..... 10-128327

(51) Int. Cl.[7] ..... G09G 3/30
(52) U.S. Cl. ..... 345/76; 345/77; 345/82
(58) Field of Search ..... 345/76–82, 36, 345/45, 46, 52; 348/800, 801; 315/169.1–169.4

(56) References Cited

U.S. PATENT DOCUMENTS 5,748,160 A * 5/1998 Shieh et al. ..... 345/82
5,812,105 A * 9/1998 Van de Ven ..... 345/83
5,828,181 A * 10/1998 Okuda ..... 315/169.3
5,844,368 A * 12/1998 Okuda et al. ..... 315/169.3
5,877,695 A * 3/1999 Kubes et al. ..... 340/815.4
5,973,456 A * 10/1999 Osada et al. ..... 315/169.1

* cited by examiner

*Primary Examiner*—Richard Hjerpe
*Assistant Examiner*—Alexander Eisen
(74) *Attorney, Agent, or Firm*—Arent Fox Kintner Plotkin & Kahn, PLLC

(57) ABSTRACT

The present invention provides an electroluminescent display which allows each of Red (R), Green (G), and Blue (B) light-emitting elements to be built up simultaneously for emitting light at predetermined instantaneous luminance in order to improve the reproducibility of gradations when addressed by a pulse-width modulation drive. The electroluminescent display has a charging means for charging at least any one of the R, G, and B light-emitting elements in the duration between the end of a scan and the start of the subsequent scan. The charging means charges different amounts of charge to each of the R, G, and B light-emitting elements. While scanning a scanning line, a power supply is connected to a predetermined drive line in response to the scan on the scanning line, hereby causing a light emission by the light-emitting element connected to the intersection of the scanning line and the drive line.

20 Claims, 12 Drawing Sheets

ELECTROLUMINESCENT DISPLAY AND DRIVE METHOD THEREFOR

BACKGROUND OF THE INVENTION

The present invention relates to an electroluminescent display and its drive method for displaying in color by using elements such as organic electroluminescent elements.

Heretofore, matrix displays are already known wherein light-emitting elements made from a material such as organic electroluminescence are used. Such a conventional matrix display has a matrix (lattice) of a plurality of anode lines and a plurality of cathode lines, and a plurality of light-emitting elements each of which is connected to each of the intersections of the matrix of the anode lines and cathode lines. For display in full color, R (red), G (green), and B (blue) light-emitting elements are arranged in order in such a manner that these three light-emitting elements are formed in one group so as to constitute one pixel. Each light-emitting element to be connected to each intersection can be represented by an electroluminescent element E with the diode properties and the parasitic capacitance C connected in parallel to the electroluminescent element E as shown in FIG. 1 in the attached drawings.

An example of this type of conventional full-color matrix displays will be described referring to FIG. 2 to FIG. 4 in the attached drawings. $A_1$ to $A_{768}$ are anode lines and $B_1$ to $B_{64}$ are cathode lines, so arranged as to intersect each other. Light-emitting elements R, G, and B, which emit red, green, and blue color respectively, are connected to each of the intersections of these anode and cathode lines. These light-emitting elements R, G, and B are arranged respectively in such a regular manner that light-emitting elements of the same color are connected to the same anode line. That is, the layout is constituted in such a manner that the anode line $A_1$ has 64 light-emitting elements of R connected thereto, the anode line $A_2$ has 64 light-emitting elements of G connected thereto, and the anode line $A_3$ has 64 light-emitting elements of B connected thereto. On the other hand, cathode lines have light-emitting elements of R, G, and B connected thereto repeatedly and sequentially. Thus, three light-emitting elements R, G, and B, which are adjacent to each other, form a unit pixel E as a group. As shown in the drawings, 16384 pixels of $E_{1'1}$ to $E_{256'64}$ are to be arranged in a matrix.

A cathode line scanning circuit 1 comprises scanning switches $\mathbf{5}_1$ to $\mathbf{5}_{64}$ for scanning cathode lines $B_1$ to $B_{64}$ in sequence. Each scanning switch $\mathbf{5}_1$ to $\mathbf{5}_{64}$ is connected at one end thereof to a reverse bias voltage Vcc of a constant-voltage power supply, while the other end thereof is connected to the ground (0 V). This reverse bias voltage Vcc acts to prevent emission of light-emitting elements connected to a cathode line $B_1$ to $B_{64}$ not being scanned.

An anode drive circuit 2 comprises constant-current power supplies $\mathbf{2}_1$ to $\mathbf{2}_{768}$ and drive switches $\mathbf{6}_1$ to $\mathbf{6}_{768}$ for selecting anode lines to be connected to the constant-current power supply $\mathbf{2}_1$ to $\mathbf{2}_{768}$ out of anode lines $A_1$ to $A_{768}$. Turning any drive switch ON will allow the constant-current power supply $\mathbf{2}_1$ to $\mathbf{2}_{768}$ to be connected to the anode line corresponding to the drive switch.

A anode reset circuit 3 comprises shunt switches $\mathbf{7}_1$ to $\mathbf{7}_{768}$ for connecting the anode lines $A_1$ to $A_{768}$ to the ground (0 V).

A light-emission control circuit 4 is provided for controlling the cathode line scanning circuit 1, anode drive circuit 2, and anode reset circuit 3 in response to light-emission data to be input.

Referring to FIGS. 2 to 4, the operation of the full-color matrix display will be described. The operation to be described below is an example wherein the cathode line $B_1$ is scanned to cause a pixel $E_{1'1}$ to emit light and then the cathode line $B_2$ is scanned to cause the pixel $E_{2'2}$ to emit light. In addition, for the sake of understanding the explanation, light-emitting elements which are emitting light are shown with diode symbols, while light-emitting elements which are not emitting light are shown with capacitor symbols.

FIG.2 shows the state wherein the pixel $E_{1'1}$ is emitting light. In this state, the cathode line $B_1$ is being scanned with a scanning switch $\mathbf{5}_1$ switched to the ground potential. Scanning switches $\mathbf{5}_2$ to $\mathbf{5}_{64}$ have been switched to the constant-voltage power supply and thus the cathode lines $B_2$ to $B_{64}$ are subjected to the reverse bias voltage Vcc. On the other hand, the anode lines $A_1$ to $A_3$ are connected to the constant-current power supply $\mathbf{2}_1$ to $\mathbf{2}_3$ by means of the drive switches $\mathbf{6}_1$ to $\mathbf{6}_3$ and the shunt switches $\mathbf{7}_1$ to $\mathbf{7}_3$ are made open. Other anode lines $A_4$ to $A_{768}$ are connected to the ground potential by means of the shunt switches $\mathbf{7}_4$ to $\mathbf{7}_{768}$ with the drive switches $\mathbf{6}_4$ to $\mathbf{6}_{768}$ made open.

Thus, in the state shown in FIG. 2, only pixel $E_{1'1}$ is forward-biased in which a driving current is flowing in the direction shown by the arrow from the constant-current power supply $\mathbf{2}_1$, caused to emit light. The parasitic capacitance of the pixel $E_{1'1}$ is charged in the forward direction.

In this case, the light-emitting elements R, G, and B in pixels $E_{1'2}$ to $E_{1'64}$ are connected to the constant-power supplies $\mathbf{2}_1$ to $\mathbf{2}_3$. However, since the cathode lines are connected to the constant-voltage supplies so as to be kept at the reverse bias voltage Vcc, the voltage across the both sides of the light-emitting elements are almost 0V and thus these light-emitting elements do not emit light. In addition, the pixels $E_{2'1}$ to $E_{256'1}$ are connected at the both sides thereof to the ground potential and thus do not emit light. Furthermore, the pixels $E_{2'2}$ to $E_{256'64}$ are reverse-biased and thus do not emit light with the parasitic capacitance of the light-emitting elements charged in the reverse direction as shown in the drawing (by hatching the capacitors).

After the cathode line $B_1$ has been scanned and before the cathode line $B_2$ is started to be scanned, all the anode lines $A_1$ to $A_{768}$ and cathode lines $B_1$ to $B_{64}$ are once shunted to the ground potential to be reset to 0V. That is, as shown in FIG. 3, all the drive switches $\mathbf{6}_1$ to $\mathbf{6}_{768}$ are turned OFF, while all the scanning switches $\mathbf{5}_1$ to $\mathbf{5}_{64}$ and all the shunt switches $\mathbf{7}_1$ to $\mathbf{7}_{768}$ are switched to the ground potential. Since this causes all the anode and cathode lines to become the same potential of 0V, all the charges which were charged in each light-emitting element will be discharged.

Then, as shown in FIG. 4, the cathode line $B_2$ is started to scan. That is, only the scanning switch $\mathbf{5}_2$ corresponding to the cathode line $B_2$ is switched to the ground potential with other scanning switches $\mathbf{5}_1$, $\mathbf{5}_3$ to $\mathbf{5}_{64}$ connected to the reverse bias voltage Vcc and drive switches $\mathbf{6}_4$ to $\mathbf{6}_6$ switched to the constant-current power supply $\mathbf{2}_4$ to $\mathbf{2}_6$. Consequently, the anode lines $A_4$ to $A_6$ are driven, shunt switches $\mathbf{7}_1$ to $\mathbf{7}_3$, $\mathbf{7}_7$ to $\mathbf{7}_{768}$ are turned ON, and the anode lines $A_1$ to $A_3$, $A_7$ to $A_{768}$ are turned in the potential thereof to 0V.

As described above, since all the light-emitting elements have zero electric charge in the moment of switching each switch, the anode lines $A_4$ to $A_6$ has the potential of Vcc (more accurately 63/64 Vcc). This allows the light-emitting elements of the pixel $E_{2'2}$, which is to emit light subsequently, to be charged at a dash by charging currents from a plurality of paths shown by the arrows in FIG. 4, the parasitic capacitance of each light-emitting element is charged instantaneously, and thus these light-emitting elements emit light at predetermined instantaneous luminance.

Concerning the reset operation mentioned above, the present applicant has already proposed the method disclosed in Japanese Patent Application Laid Open No. 9-232074. The reset driving method disclosed in the above patent publication solves the problem that the reverse-direction electric charges of pixels $E_{2'2}$ to $E_{2'64}$ charged at the time of scanning the cathode line $B_1$ cause light-emitting elements on the cathode line $B_2$ to be delayed in rising for emitting light when the cathode line $B_2$ is scanned.

That is, in order to allow light-emitting elements to emit light at predetermined instantaneous luminance, the voltage across the both sides of the respective light-emitting element needs to be built up to a certain specified value. For this purpose, the parasitic capacitance of the light-emitting element must be charged by a predetermined amount of charge. Canceling the reverse-direction charges charged to pixels $E_{2'2}$ to $E_{2'64}$ will enable the anode lines $A_4$ to $A_6$, which are driven when the cathode line $B_2$ is scanned, to turn the voltages thereof to Vcc instantaneously (that is, the voltage across the both ends of each light-emitting element of the pixel $E_{2'2}$ can be turned approximately to Vcc in an instant), and whereby a quick charge is made possible to the light-emitting elements of the pixel $E_{2'2}$.

According to the conventional reset driving method, each light-emitting element of the pixel $E_{2'2}$ which is to emit light in the moment the cathode line $B_2$ is about to be scanned has approximately a voltage of Vcc across the both sides of the light-emitting element.

However, each light-emitting element of R, G, and B has a difference in the luminescent material and in the element structure, and thus has different luminance-voltage characteristics in most cases. According to the conventional reset driving method, a light-emitting element of R, G, and B, which has the specified value of a voltage across the both sides thereof closer to Vcc, is allowed to emit light more quickly at predetermined instantaneous luminance. However, there may be a case in which the specified value of a voltage across the both sides of a light-emitting element is considerably greater than Vcc. In this case, the method has such a problem that the light-emitting element needs to be charged more by the current flowing from the constant-current power supply for light emission and is consequently delayed in rising for light emission. The method has also such a problem that a driving method such as the pulse-width modulation drive, in which gradations are expressed by the duration of light emission within a scan period, provides bad linearity of gradations.

SUMMARY OF THE INVENTION

The object of the present invention is to solve the forgoing problems involved in conventional methods and to provide an electroluminescent display which allows each of R, G, and B light-emitting elements to be built up simultaneously for emitting light at predetermined instantaneous luminance in order to improve the reproducibility of gradations when addressed by the pulse-width modulation drive.

Another object of the present invention is to provide a method of driving the electroluminescent display.

To achieve the first object, according to first aspect of the present invention there is provided an electroluminescent display in which a matrix of anode lines and cathode lines is provided, either one of which is used as scanning lines and the other as drive lines, a light-emitting element is connected to an intersection of the scanning line and the drive line in such a manner that light-emitting elements having the same color of red, green and blue are connected to each drive line, and while scanning a scanning line, a power supply is connected to a predetermined drive line in response to the scan on the scanning line, hereby causing a light emission by the light-emitting element connected to the intersection of the scanning line and the drive line, wherein a charging means is provided for charging at least any one of said red, green and blue light-emitting elements in the duration between the end of a scan and the start of the subsequent scan, and the charging means charges different amounts of charge to the red, green and blue light-emitting elements.

The charging means may be intended for charging all of said light-emitting elements.

Each of the red, green and blue light-emitting elements may have a different specified voltage across the both ends thereof under steady light-emission conditions.

The charging means may be arranged in such a manner that positive electric charge is charged to an element of said red, green and blue light-emitting elements which has the highest value of said specified light-emission voltage, no charge is charged to an element having the second highest voltage, and negative electric charge is charged to an element having the lowest value of said specified light-emission voltage.

According to second aspect of the present invention there is provided an electroluminescent display in which a matrix of anode lines and cathode lines is arranged, either one of which is used as scanning lines and the other as drive lines, a light-emitting element is connected to an intersection of the respective scanning line and the respective drive line in such a manner that light-emitting elements having the same color of red, green and blue are connected to each drive line, and while scanning a scanning line, a power supply is connected to a predetermined drive line in response to the scan on the scanning line, hereby causing a light emission by the light-emitting element connected to the intersection of the scanning line and the drive line, wherein the scanning lines are made connectable to either one of a first constant-voltage power supply or a ground means, the drive lines are made connectable to either one of the power supply, ground means and a second constant-voltage power supply for charging electric charge to the light-emitting elements, the scanning lines are connected to the ground means, the drive lines are connected to the second constant-voltage power supply during the duration between the end of a scan and the start of the subsequent scan, and the second constant-voltage power supply applies a different voltage depending on which element of the red, green and blue light-emitting elements is to be connected thereto.

Each of the red, green and blue light-emitting element may have a different specified voltage across the both ends thereof under steady light-emission conditions.

The second voltage supply is provided only for drive lines to which light-emitting elements having the highest value and the lowest value of the light-emission specified voltage are connected among the red, green and blue light-emitting elements, and the light-emitting element having the highest value of the specified voltage may be forward-biased and the light-emitting element having the lowest value of the specified voltage may be reverse-biased.

In the scan period during which an arbitrary scanning line is being scanned, the ground means may be connected to the scanning line which is being scanned, whereas the first constant-voltage power supply may be connected to the scanning line which is not being scanned; and the power supply may be connected to a drive line to which a light-emitting element to be emitting light is connected, whereas the ground means may be connected to a drive line to which a light-emitting element not to be emitting light is connected.

The light-emitting elements may be formed of organic electroluminescent materials.

According to third aspect of the present invention the second object of the present invention is attained by providing a method of driving an electroluminescent display in which a matrix of anode lines and cathode lines is formed, either one of which is used as scanning lines and the other as drive lines, a light-emitting element is connected to an intersection of the respective scanning line and the respective drive line in such a manner that light-emitting elements having the same color of red, green and blue are connected to each drive line, and while scanning a scanning line, a power supply is connected to a predetermined drive line in response to the scan on the scanning line, hereby causing a light emission by the light-emitting element connected to the intersection of the scanning line and the drive line, wherein different amounts of charge is charged to the red, green and blue light-emitting elements during the duration between the end of a scan and the start of the subsequent scan.

With the method of driving an electroluminescent display according to the present invention, during the duration between the end of scanning a scanning line and the start of scanning the subsequent scanning line, positive electric charge may be charged to the light-emitting element, among the red, green and blue light-emitting elements, having the highest value of the light-emission specified voltage, a voltage across the both ends thereof at the state of steady light emission. The light-emitting element having the second highest value of specified voltage may have no electric charge charged, whereas the one having the lowest value of the light-emission specified voltage may have negative electric charge charged.

According to a fourth aspect of the present invention there is provided a method of driving an electroluminescent display in which a matrix of anode lines and cathode lines is formed, either one of which is used as scanning lines and the other as drive lines, a light-emitting element is connected to an intersection of the respective scanning line and the respective drive line in such a manner that light-emitting elements having the same color of red, green and blue are connected to each drive line, and while scanning a scanning line, a power supply is connected to a predetermined drive line in response to the scan on the scanning line, hereby causing a light emission by the light-emitting element connected to the intersection of the respective scanning line and the respective drive line, wherein the scanning lines are made connectable to either one of a first constant-voltage power supply or a ground means, the drive lines are made connectable to either one of the power supply, ground means and a second constant-voltage power supply for charging electric charge to the light-emitting elements, in the scan period during which an arbitrary scanning line is being scanned, the ground means is connected to the scanning line which is being scanned, whereas the first constant-voltage power supply is connected to the scanning line which is not being scanned, the power supply is connected to a drive line to which a light-emitting element to be emitting light is connected, whereas the ground means is connected to a drive line to which a light-emitting element not to be emitting light is connected, the scanning lines are connected to said ground means, the drive lines are connected to the second constant-voltage power supply during the duration between the end of a scan and the start of the subsequent scan, and the second constant-voltage power supply applies a different voltage depending on which element of the red, green and blue light-emitting elements is to be connected thereto.

The second voltage supply is provided only for a drive line to which the light-emitting element having the highest value and the lowest value of the light-emission specified voltage is connected among the red, green and blue light-emitting elements. The light-emitting element having the highest value of the specified voltage may be forward-biased and the light-emitting element having the lowest value of the specified voltage may be reverse-biased.

The light-emitting elements may be formed of organic electroluminescent materials.

In the present invention, in the moment a scan is switched from an arbitrary cathode line to the subsequent line, each of the R, G and B light-emitting elements is electrically charged depending on the element. Therefore, each of R, G, and B light-emitting elements can be built up simultaneously for emitting light at predetermined instantaneous luminance so as to improve the reproducibility of gradations when driven by the pulse-width modulation drive.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENTS

A plurality of embodiments of the present invention will be described below referring to the attached drawings. FIGS.

Figure 1:
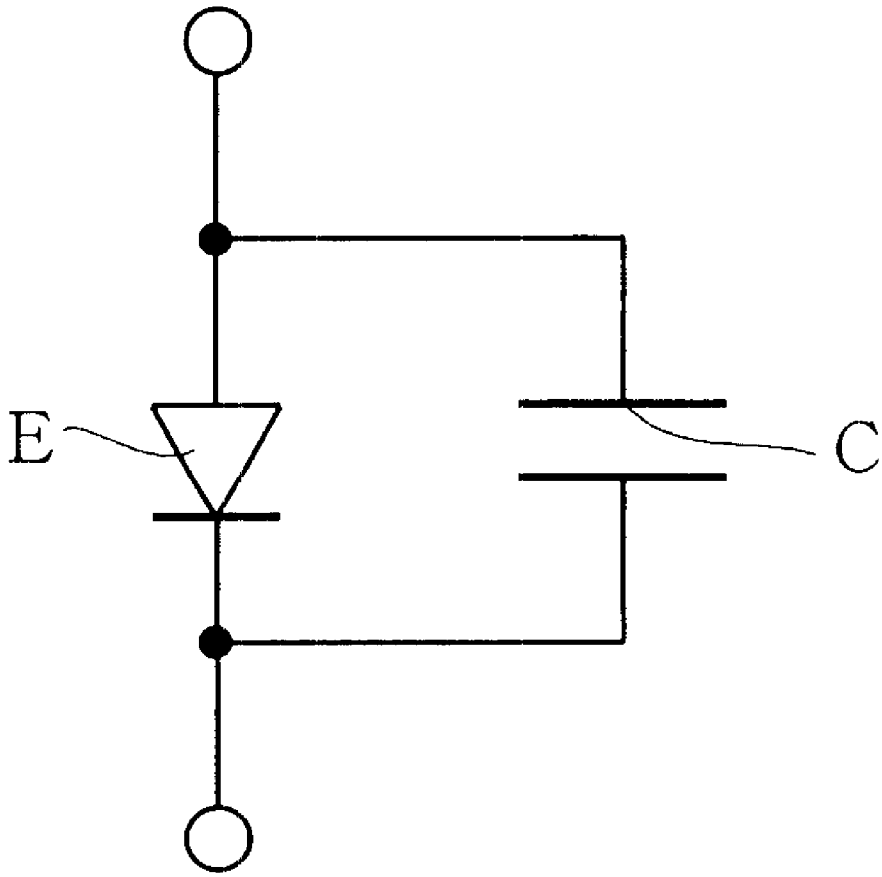
FIG. 1 PRIOR ART
FIG. 1 is a view showing an equivalent circuit of a light-emitting element.
Figure 2:
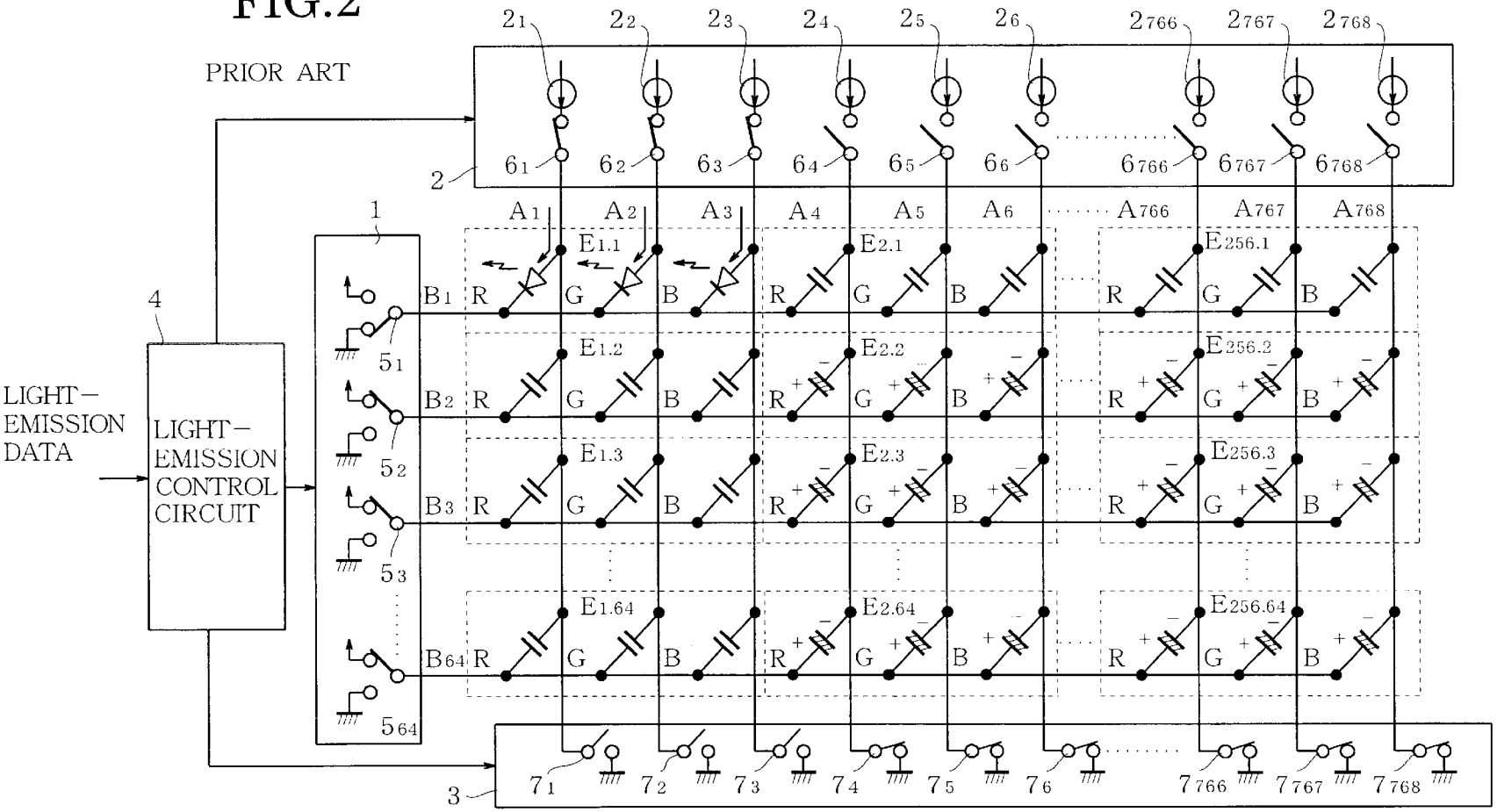
FIG.2 PRIOR ART
FIG. 2 is an explanatory diagram showing a conventional electroluminescent display under an operating condition.
Figure 3:
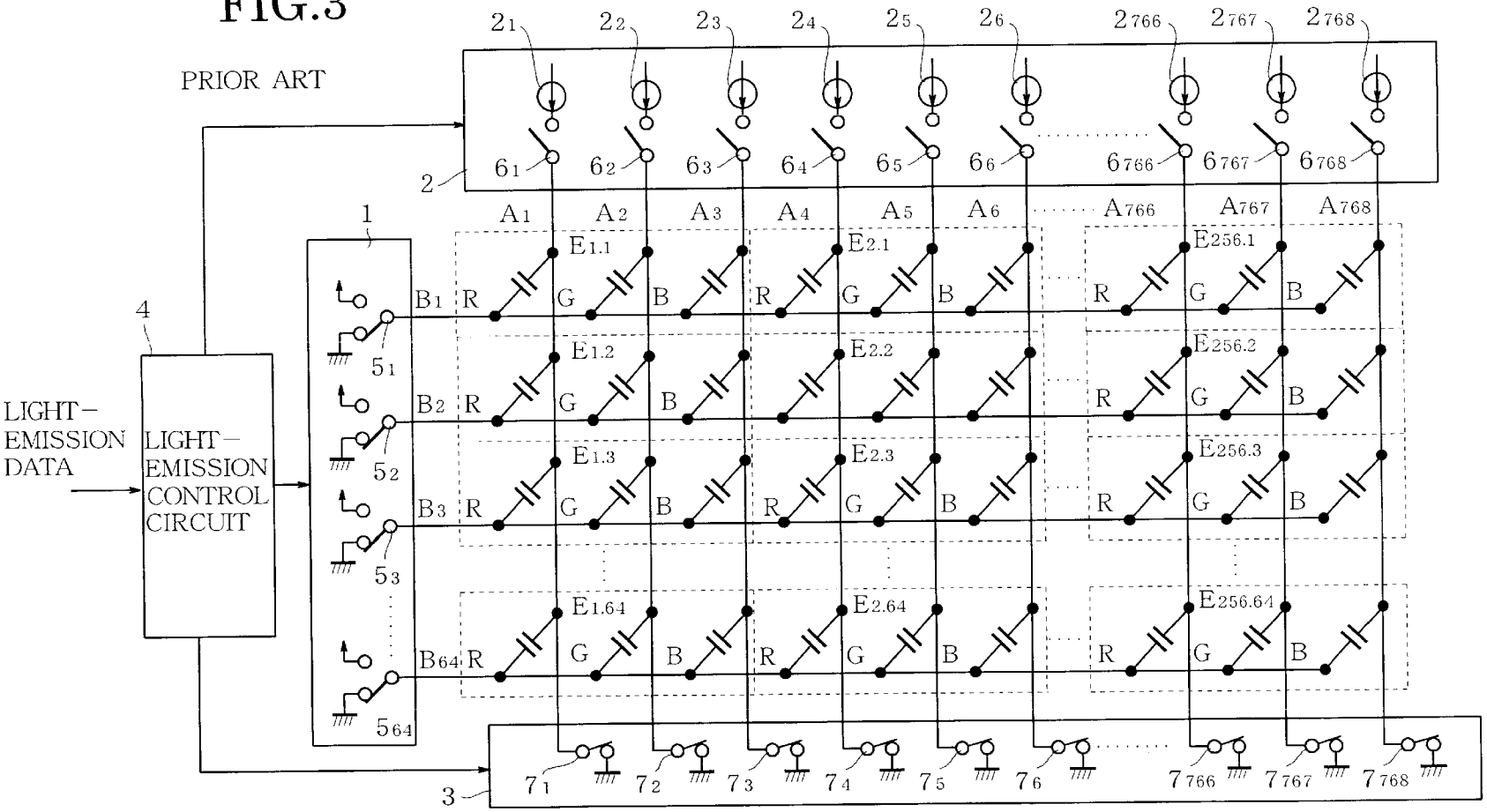
FIG.3 PRIOR ART
FIG. 3 is an explanatory diagram showing the conventional electroluminescent display shown in FIG. 2 under another operating condition.
Figure 4:
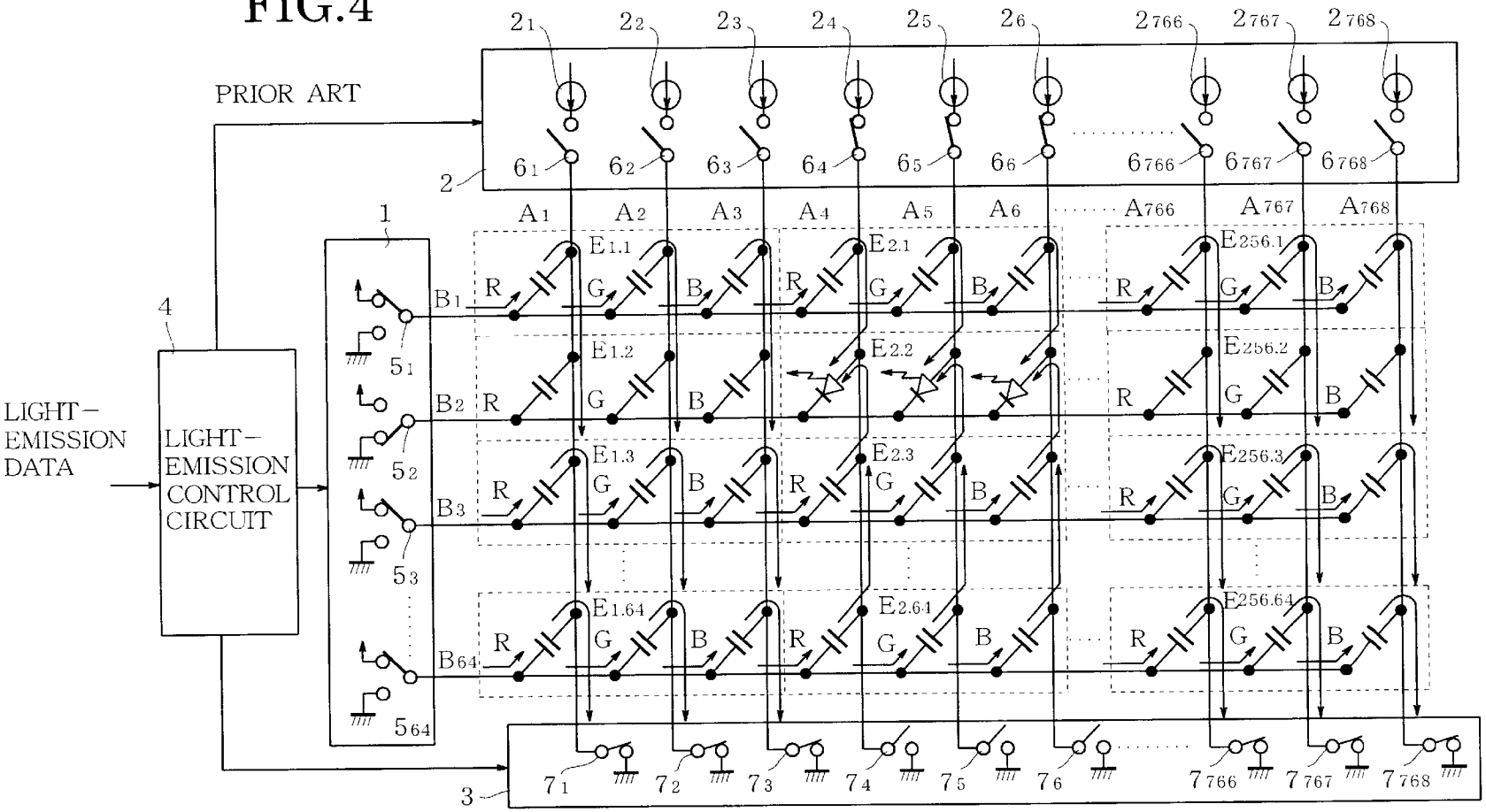
FIG.4 PRIOR ART
FIG. 4 is an explanatory diagram showing the conventional electroluminescent display shown in FIG. 2 under still another operating condition.

5 to 8 illustrate an electroluminescent display according to the first embodiment of the present invention. The electroluminescent display shown in the drawings are different, in that an anode drive circuit 2 is provided with constant-voltage power supplies $V_R$, $V_G$ and $V_B$ corresponding to each of R, G and B light-emitting elements, from the conventional display shown in FIGS. 2 to 4.

Referring to FIGS. 5 to 8, $A_1$ to $A_{768}$ are anode lines and $B_1$ to $B_{64}$ are cathode lines, so arranged as to intersect each other. Light-emitting elements R, G and B, which emit red, green and blue color respectively, are connected to each of the intersections of these anode and cathode lines and arranged in a regular manner. That is, the anode line $A_1$ has 64 light-emitting elements R connected thereto, the anode line $A_2$ has 64 light-emitting elements G connected thereto, and the anode line $A_3$ has 64 light-emitting elements B connected thereto. Thus, an anode line has light-emitting elements of only the same color, and cathode lines have light-emitting elements R, G and B connected thereto repeatedly in that order. Three light-emitting elements R, G and B, which are adjacent to each other, form a unit pixel E as a group. For example, the pixel $E_{1'1}$ consists of light-emitting elements $R_{1'1}$, $G_{1'1}$ and $B_{1'1}$. As shown in the drawings, 16384 pixels of $E_{1'1}$ to $E_{264'64}$ are arranged in a matrix.

Reference numeral 1 denotes a cathode line scanning circuit which is provided with scanning switches $\mathbf{5}_1$ to $\mathbf{5}_{64}$ for scanning cathode lines $B_1$ to $B_{64}$ in a sequential manner. Each scanning switch $\mathbf{5}_1$ to $\mathbf{5}_{64}$ is connected at one end thereof to reverse bias voltage Vcc of a constant-voltage power supply (a first constant-voltage power supply), while the other end thereof is connected to the ground (0 V).

Reference numeral 2 denotes an anode drive circuit which is provided with constant-current power supplies $\mathbf{2}_1$ to $\mathbf{2}_{768}$, constant-voltage power supplies $V_R$, $V_G$ and $V_B$ (second constant-voltage power supplies), and drive switches $\mathbf{6}_1$ to $\mathbf{6}_{768}$. The drive switches serve to select anode lines from among the anode lines $A_1$ to $A_{768}$. The selected anode lines are connected to the constant-current power supplies $\mathbf{2}_1$ to $\mathbf{2}_{768}$ or to the constant-voltage power supplies $V_R$, $V_G$ and $V_B$. Turning an arbitrary drive switch ON will cause said anode lines to have the constant-current power supplies $\mathbf{2}_1$ to $\mathbf{2}_{768}$ or the constant-voltage power supplies $V_R$, $V_G$ and $V_B$ connected. The constant-voltage power supplies $V_R$, $V_G$ and $V_B$ are provided corresponding to the anode lines to which the light-emitting elements R are connected, the anode lines to which the light-emitting elements G are connected, and the anode lines to which the light-emitting elements B are connected. As shown in the drawings, anode lines $A_1$, $A_4$, $A_7$ are provided in a connectable manner with the constant-voltage power supply $V_R$, anode lines $A_2$, $A_5$, $A_8$, . . . provided with the constant-voltage power supply $V_G$, and anode lines $A_3$, $A_6$, $A_9$, . . . provided with the constant-voltage power supply $V_B$ respectively.

Voltages applied by the constant-voltage power supplies $V_R$, $V_G$ and $V_B$ are preferably set as follows. That is, supposing that $V_r$, $V_g$ and $V_b$ are the voltages across the both ends of R, G and B light-emitting elements (light-emission specified voltage) when they are emitting light at predetermined instantaneous luminance, $V_R$, $V_G$ and $V_B$ are given as follows.

$$V_R = V_r - Vcc \quad (1)$$

$$V_G = V_g - Vcc \quad (2)$$

$$V_B = V_b - Vcc \quad (3)$$

Setting the voltages applied by the constant-voltage power supplies $V_R$, $V_G$, and $V_B$ as mentioned above enables the voltages of the both sides of R, G, and B light-emitting elements to rise to the specified voltage at an instant as soon as a scan is switched over. This will be described in more detail later.

Reference numeral 3 denotes an anode reset circuit comprising shunt switches $\mathbf{7}_1$ to $\mathbf{7}_{768}$ for connecting the anode lines $A_1$ to $A_{768}$ to the ground (0 V).

Reference numeral 4 denotes a light-emission control circuit which controls the cathode line scanning circuit 1, anode drive circuit 2 and anode reset circuit 3 in response to light-emission data to be input.

Referring to FIGS. 5 to 8, the operation of the full-color matrix display of the present embodiment will now be described. The operation to be described below is a case where the cathode line $B_1$ is scanned to cause the light-emitting elements $R_{1'1}$, $G_{1'1}$, and $B_{1'1}$, of pixel $E_{1'1}$ to emit light, and then the cathode line $B_2$ is scanned to cause the light-emitting elements $R_{2'2}$, $G_{2'2}$, and $B_{2'2}$, of the pixel $E_{2'2}$ to emit light. In addition, for the sake of understanding the explanation, light-emitting elements which are emitting light are shown with diode symbols, while light-emitting elements which are not emitting light are shown with capacitor symbols.

Figure 5:
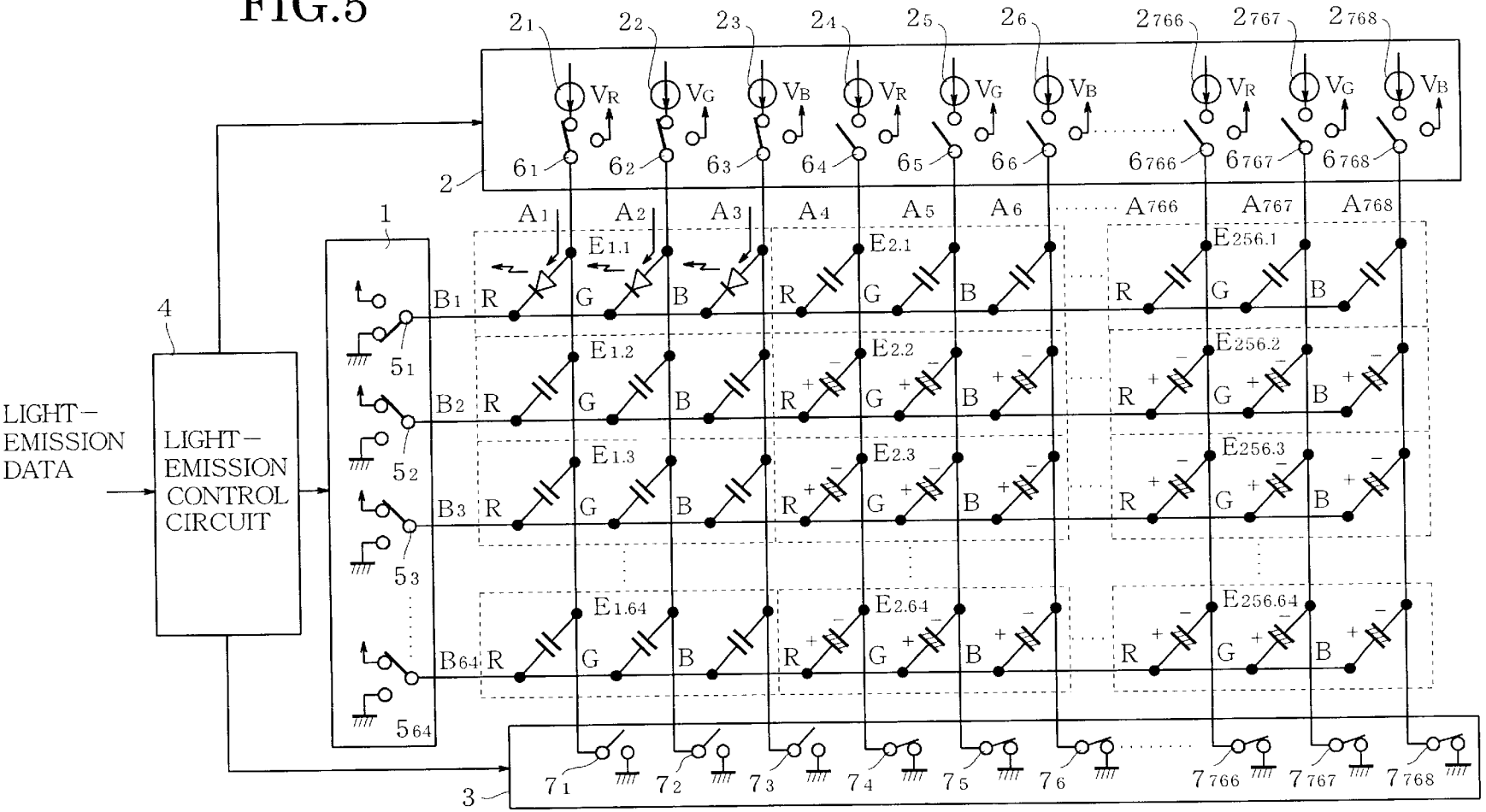
FIG. 5 is an explanatory diagram showing the electroluminescent display according to the first embodiment of the present invention under an operating condition.

FIG. 5 shows the state where the pixel $E_{1'1}$ is emitting light. In this state, the cathode line $B_1$ is being scanned with a scanning switch $\mathbf{5}_1$, switched to the ground potential. Scanning switches $\mathbf{5}_2$ to $\mathbf{5}_{64}$ have been switched to the constant-voltage power supply and thus the cathode lines $B_2$ to $B_{64}$ are subjected to the reverse bias voltage Vcc. On the other hand, the anode lines $A_1$ to $A_3$ are connected to the constant-current power supply $\mathbf{2}_1$ to $\mathbf{2}_3$ by means of the drive switches $\mathbf{6}_1$ to $\mathbf{6}_3$ and the shunt switches $\mathbf{7}_1$ to $\mathbf{7}_3$ are made open. Other anode lines $A_4$ to $A_{768}$ are connected to the ground potential by means of the shunt switches $\mathbf{7}_4$ to $\mathbf{7}_{768}$ with the drive switches $\mathbf{6}_4$ to $\mathbf{6}_{768}$ made open.

Thus, in the state shown in FIG. 5, only pixel $E_{1'1}$ is forward-biased in which a driving current is flowing in the direction shown by the arrow from the constant-current power supplies $\mathbf{2}_1$ to $\mathbf{2}_3$, caused to emit light. The parasitic capacitance of the pixel $E_{1'1}$ is charged in the forward direction in voltage across the both ends of the light-emitting elements.

Figure 6:
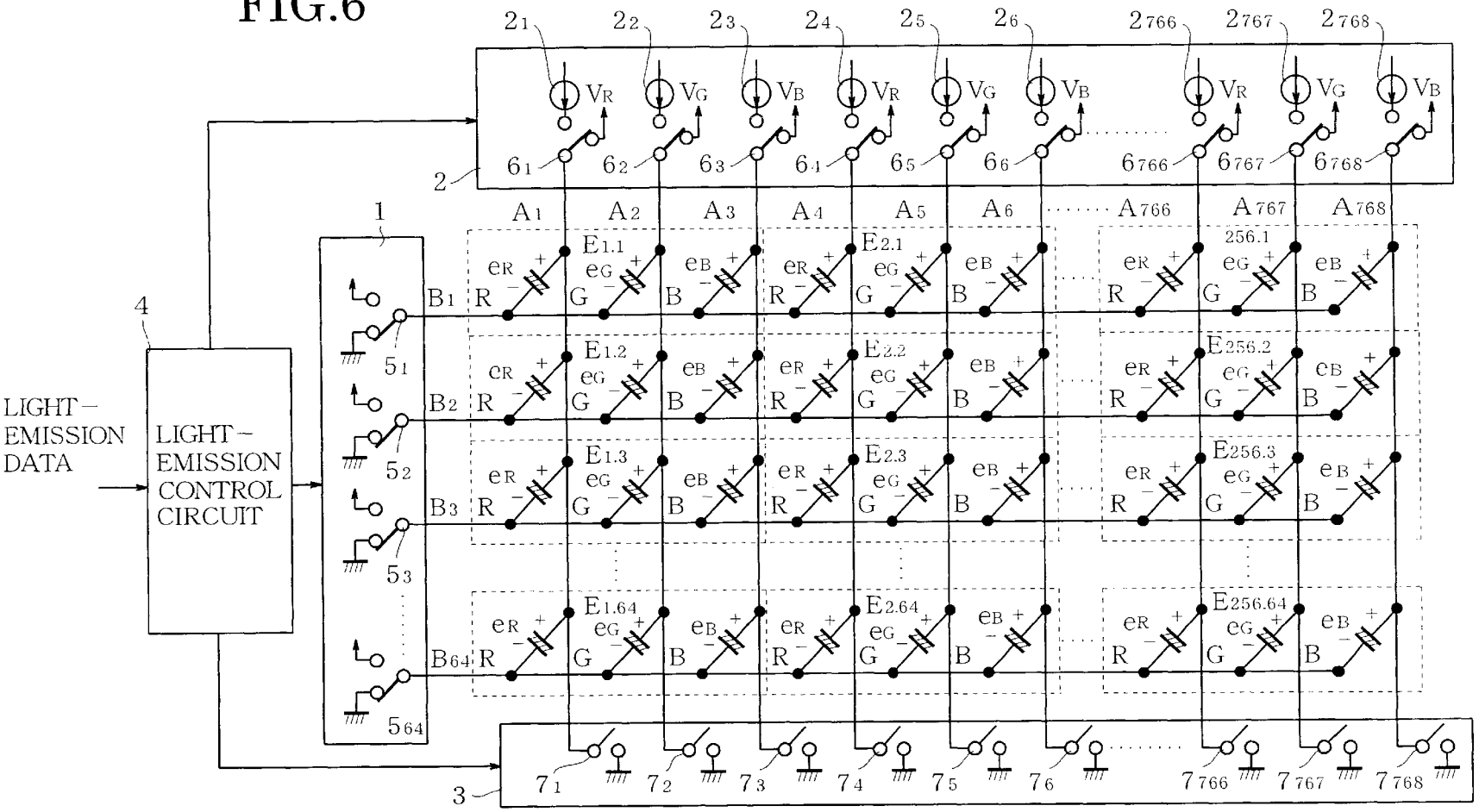
FIG. 6 is an explanatory diagram showing the electroluminescent display shown in FIG. 5 under an operating condition.

After the cathode line $B_1$ has been scanned and before the cathode line $B_2$ is started to be scanned, reset operation is performed to charge all the light-emitting elements. That is, as shown in FIG. 6, all the scanning switches $\mathbf{5}_1$ to $\mathbf{5}_{64}$ are connected to the ground potential. All the shunt switches $\mathbf{7}_1$ to $\mathbf{7}_{768}$ are also turned OFF, and all the drive switches $\mathbf{6}_1$ to $\mathbf{6}_{768}$ are switched to the constant-voltage power supplies $V_R$, $V_G$ and $V_B$.

Turning the switches as in the forgoing will cause the potential of all the cathode lines to become 0V, the potential of anode lines $A_1$, $A_4$, $A_7$ to become $V_R$, anode lines $A_2$, $A_5$, $A_8$ . . . to become $V_G$, and anode lines $A_3$, $A_6$, $A_9$ . . . to become $V_B$. Consequently, as shown in FIG. 6, the parasitic capacitance of the light-emitting elements connected to anode lines $A_1$, $A_4$, $A_7$ . . . is charged by charge eR so that the voltage across the both ends of the light-emitting elements becomes $V_R$ in the forward direction. Similarly, the light-emitting elements connected to anode lines $A_2$, $A_5$, $A_8$ . . . are charged by charge eG so that the voltage across the both ends of the light-emitting elements becomes $V_G$ in the forward direction. Likewise, the light-emitting elements connected to anode lines $A_3$, $A_6$, $A_9$ . . . are charged by charge eB so that the voltage across the both ends of the light-emitting elements becomes $V_B$ in the forward direction.

Under the conditions in the forgoing, all the R, G, and B light-emitting elements are forward-biased by voltages $V_R$, $V_G$ and $V_B$. However, the R, G and B light-emitting elements do not emit light because $V_R$, $V_G$ and $V_B$ are less than the light-emission threshold voltage (the minimum voltage required for light emission) of each light-emitting element.

Figure 7:
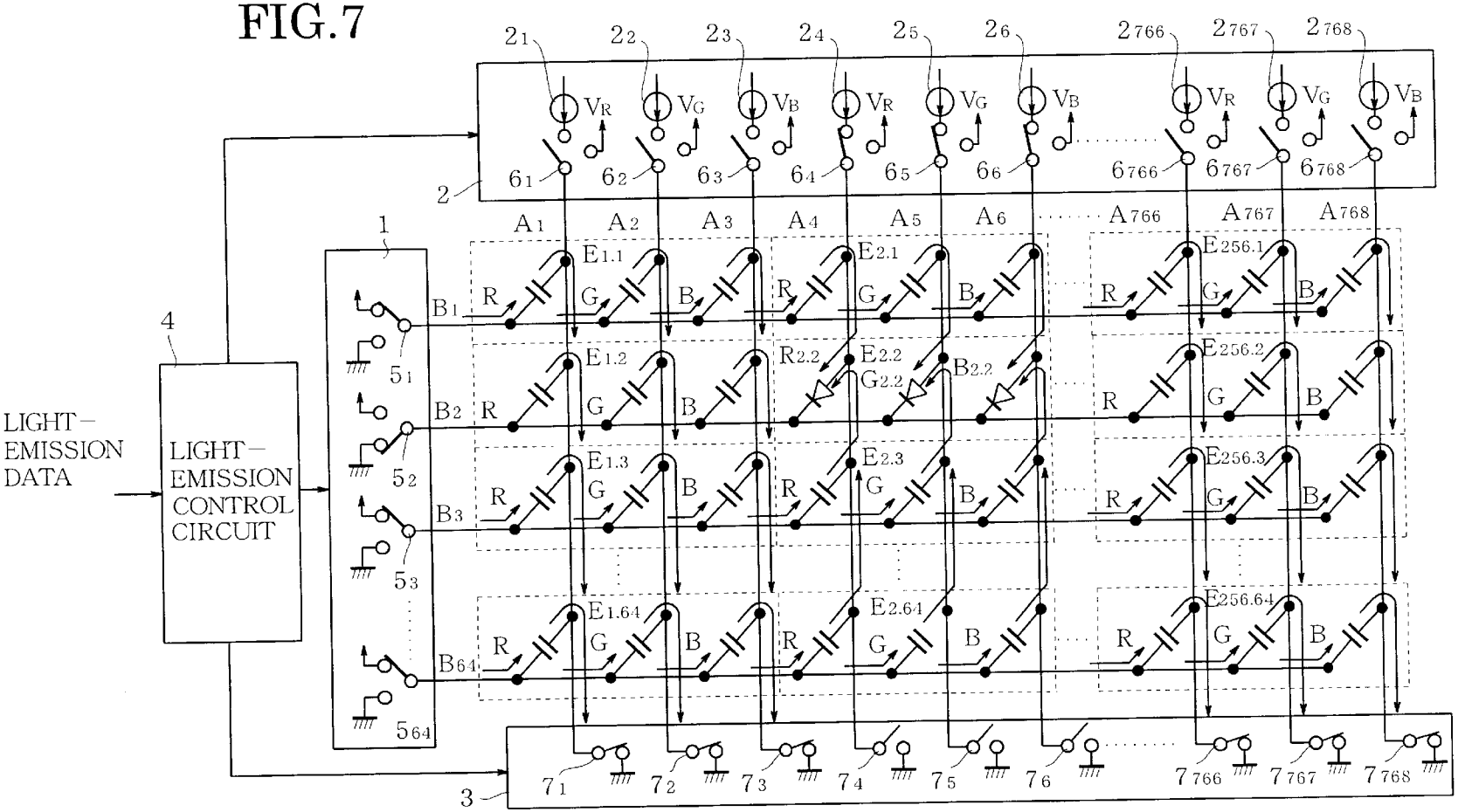
FIG. 7 is an explanatory diagram showing the electroluminescent display shown in FIG. 5 under another operating condition.

Then, the scan is moved to the cathode line $B_2$ as shown in FIG. 7. That is, only scanning switch $\mathbf{5}_2$ corresponding to the cathode line $B_2$ is switched to the ground potential, while other scanning switches $\mathbf{5}_1$, $\mathbf{5}_3$ to $\mathbf{5}_{64}$ are switched to Vcc of the constant-voltage power supplies. Only drive switches $\mathbf{6}_4$ to $\mathbf{6}_6$ are switched to the constant-current power supplies $\mathbf{2}_4$ to $\mathbf{2}_6$ to address the anode lines $A_4$ to $A_6$. The shunt switches $\mathbf{7}_1$ to $\mathbf{7}_3$, $\mathbf{7}_7$ to $\mathbf{7}_{768}$ are turned ON, and the anode lines $A_1$ to $A_3$, $A_7$ to $A_{768}$ are turned to 0V in voltage.

In the moment switching is carried out as mentioned above, all the light-emitting elements connected to the anode line $A_4$ have been charged so as to become $V_R$ in the forward direction across the both ends of the light-emitting elements. Hereby, the anode line $A_4$ will have a potential of approximately Vcc+$V_R$. That is, the light-emitting element $R_{2'2}$ of the pixel $E_{2,2}$ will have at an instant a voltage of Vcc+$V_R$ across the both ends thereof. This causes a charge current to flow into the light-emitting element $R_{2'2}$ of the pixel $E_{2'2}$ over a path leading from the constant-current power supply $\mathbf{2}_4$ through the drive switch $\mathbf{6}_4$, the anode line $A_4$ and the light-emitting element $R_{2'2}$ to the scanning switch $\mathbf{5}_2$. As shown with arrows in FIG. 7, this also causes simultaneously another charge current to flow into the light-emitting element $R_{2'2}$ over a path leading from the scanning switch $\mathbf{5}_1$ through the cathode line $B_1$, the light-emitting element $R_{2'1}$ and the light-emitting element $R_{2'2}$ to the scanning switch $\mathbf{5}_2$. This also causes simultaneously other charge currents to flow into the light-emitting element $R_{2'2}$ over paths leading from, for example, the scanning switch $\mathbf{5}_{64}$ through the cathode line $B_{64}$ the light-emitting element $R_{2'64}$ and the light-emitting element $R_{2'2}$ to the scanning switch $\mathbf{5}_2$. The light-emitting element $R_{2'2}$ will be charged instantaneously by the plurality of charge currents and then built up to the state of emitting light at predetermined instantaneous luminance.

Similarly, the light-emitting element $G_{2'2}$ will have a voltage of Vcc+$V_G$ at an instant across the both sides thereof. This causes a charge current to flow into the light-emitting element $G_{2'2}$ of the pixel $E_{2'2}$ over a path leading from the constant-current power supply $\mathbf{2}_5$ through the drive switch $\mathbf{6}_5$, the anode line $A_5$, and the light-emitting element $G_{2'2}$ to the scanning switch $\mathbf{5}_2$. As shown with arrows in FIG. 7, this also causes simultaneously another charge current to flow into the light-emitting element $G_{2'2}$ over a path leading from the scanning switch $\mathbf{5}_1$ through the cathode line $B_1$, the light-emitting element $G_{2'1}$ and the light-emitting element $G_{2'2}$ to the scanning switch $\mathbf{5}_2$. This also causes simultaneously other charge currents to flow into the light-emitting element $G_{2'2}$ over paths leading from, for example, the scanning switch $\mathbf{5}_{64}$ through the cathode line $B_{64}$ the light-emitting element $G_{2'64}$ and the light-emitting element $G_{2'2}$ to the scanning switch $\mathbf{5}_2$. The light-emitting element $G_{2'2}$ will be charged instantaneously by the plurality of charge currents and then built up to the state of emitting light at predetermined instantaneous luminance.

Furthermore in a like manner, the light-emitting element $B_{2'2}$ will have a voltage of Vcc+$V_B$ at an instant across the both sides thereof. This causes a charge current to flow into the light-emitting element $B_{2'2}$ of the pixel $E_{2'2}$ over a path leading from the constant-current power supply $\mathbf{2}_6$ through the drive switch $\mathbf{6}_6$, the anode line $A_6$, and the light-emitting element $B_{2'2}$ to the scanning switch $\mathbf{5}_2$. As shown with arrows in FIG. 7, this also causes simultaneously another charge current to flow into the light-emitting element $B_{2'2}$ over a path leading from the scanning switch $\mathbf{5}_1$ through the cathode line $B_1$, the light-emitting element $B_{2'1}$ and the light-emitting element $B_{2'2}$ to the scanning switch $\mathbf{5}_2$. This also causes simultaneously other charge currents to flow into the light-emitting element $B_{2'2}$ over paths leading from, for example, the scanning switch $\mathbf{5}_{64}$ through the cathode line $B_{64}$, the light-emitting element $B_{2'64}$ and the light-emitting element $B_{2'2}$ to the scanning switch $\mathbf{5}_2$. The light-emitting element $B_{2'2}$ will be charged instantaneously by the plurality of charge currents and then built up to the state of emitting light at predetermined instantaneous luminance.

Figure 8:
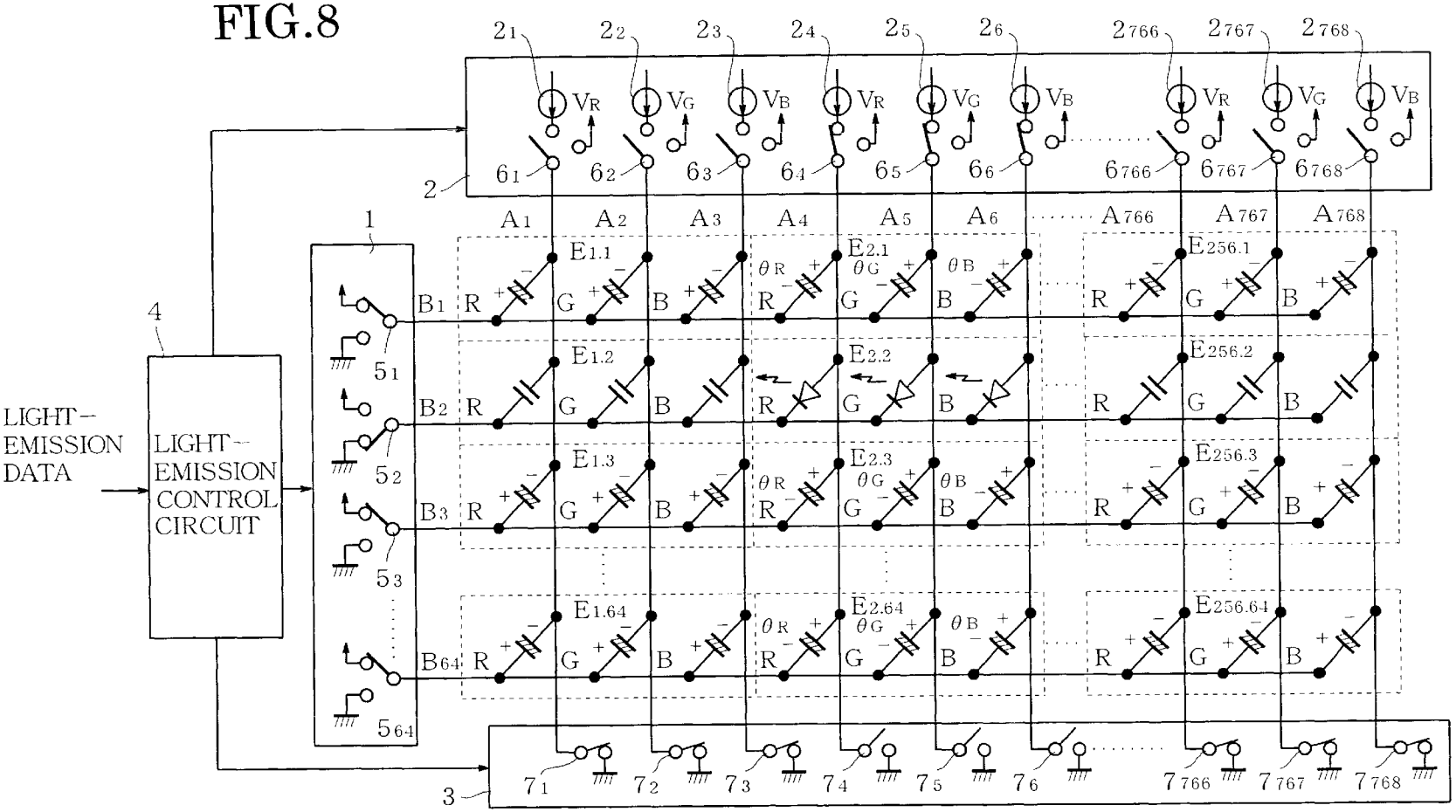
FIG. 8 is an explanatory diagram showing the electroluminescent display shown in FIG. 5 under still another operating condition.

Through the operations in the forgoing, the light-emitting elements $R_{2'2}$, $G_{2'2}$, $B_{2'2}$ of the pixels $E_{2'2}$ emit light steadily at predetermined instantaneous luminance as shown in FIG. 8. Subsequently, the light emission will be sustained by means of driving current from the constant-current power supplies $\mathbf{2}_4$, $\mathbf{2}_5$ and $\mathbf{2}_6$ during the duration of scanning the cathode line $B_2$.

Under the condition in the forgoing, the voltages across the both ends of the light-emitting elements R, G and B of the pixels $E_{2'1}$, $E_{2'3}$ to $E_{2'64}$ are $V_R$, $V_G$ and $V_B$ respectively. However, since the voltages are less than the light-emission threshold voltage, the light-emitting elements R, G, and B will never emit light.

Light-emitting elements of pixels such as the pixels $E_{1'1}$, $E_{1'3}$ to $E_{1'64}$ which are not excited to emit light are also charged through the paths shown with arrows in FIG. 7. However, since charging is carried out reverse-biased, the light-emitting elements R, G, B of these pixels will never emit light accidentally.

As mentioned above, the electroluminescent display according to the first embodiment of the present invention is arranged so that the light-emitting elements R, G, B are to be charged by a different amount of charge into the parasitic capacitance thereof in the duration from the end of a scan to the start of the subsequent scan. Therefore, as soon as a scan is switched to the subsequent scanning line, the light-emitting elements of the subsequent scanning line are allowed to emit light instantaneously at predetermined instantaneous luminance. Furthermore, light-emitting elements R, G and B, though having different individual specified voltages, are allowed to build up simultaneously to emit light at predetermined instantaneous luminance. Thereby, the accuracy of assigning weights to gradations is improved when addressed by the pulse-width modulation drive.

In the forgoing description, the case where the amounts of charge to be charged to light-emitting elements R, G and B of three colors are individually different has been explained. However, the present invention is not limited to this case. For example, in the case where light-emitting element R is equal to G but not equal to B in the voltage across the both ends thereof when they emit light at predetermined instantaneous luminance, charging voltage applied to one of the elements may differ from that applied to other two.

Voltages applied by the constant-voltage power supplies $V_R$, $V_G$, and $V_B$ are best set, but not limited, to those mentioned in equation (1) to (3). Voltages applied by the constant-voltage power supplies $V_R$, $V_G$, and $V_B$ may be set so as to approach as close to the voltage across the both sides of the light-emitting element as possible in the moment of switching a scan when emitting light at predetermined instantaneous luminance.

The second embodiment of the present invention will be described referring to FIGS. 9 to 12. In the second embodiment of the present invention, a consideration has been given to the voltages applied, at the time of reset operation, to the R, G and B light-emitting elements. The constant-voltage power supplies of the anode drive circuit 2 have been reduced in number for saving cost compared with the forgoing first embodiment.

In the second embodiment, voltages applied by constant-voltage power supplies $V_R$, $V_G$, and $V_B$, and reverse bias voltage Vcc are set as follows. That is, supposing that Vr, Vg, and Vb (Vr>Vg>Vb), are the voltages across the both ends of R, G and B light-emitting elements (light-emission specified voltage) when emitting light at predetermined instantaneous luminance, $V_R$, $V_G$ and $V_B$ are given as follows.

$$Vg=Vcc \tag{4}$$

$$V_R=Vr-Vcc \tag{5}$$

$$V_G=0 \tag{6}$$

$$V_B=Vb-Vcc \tag{7}$$

That is, the constant-voltage power supply $V_G$ has been removed with the applied voltage by the constant-voltage power supply $V_B$ being negative. As can be seen in equation (4) to (7), the second embodiment is different from the first embodiment only in that the constant-voltage power supply $V_G$ connected to anode lines $A_2$, $A_5$, $A_8$ . . . is not provided.

The operation of the second embodiment will be described below.

The operation is the case where after the cathode line $B_1$ is scanned to cause the light-emitting elements $R_{1'1}$, $G_{1'1}$, and $B_{1'1}$ of the pixel $E_{1'1}$ to emit light, the scan is switched to the cathode line $B_2$ to allow the light-emitting elements $R_{2'2}$, $G_{2'2}$ and $B_{2'2}$ of the pixel $E_{2'2}$ to emit light.

Figure 9:
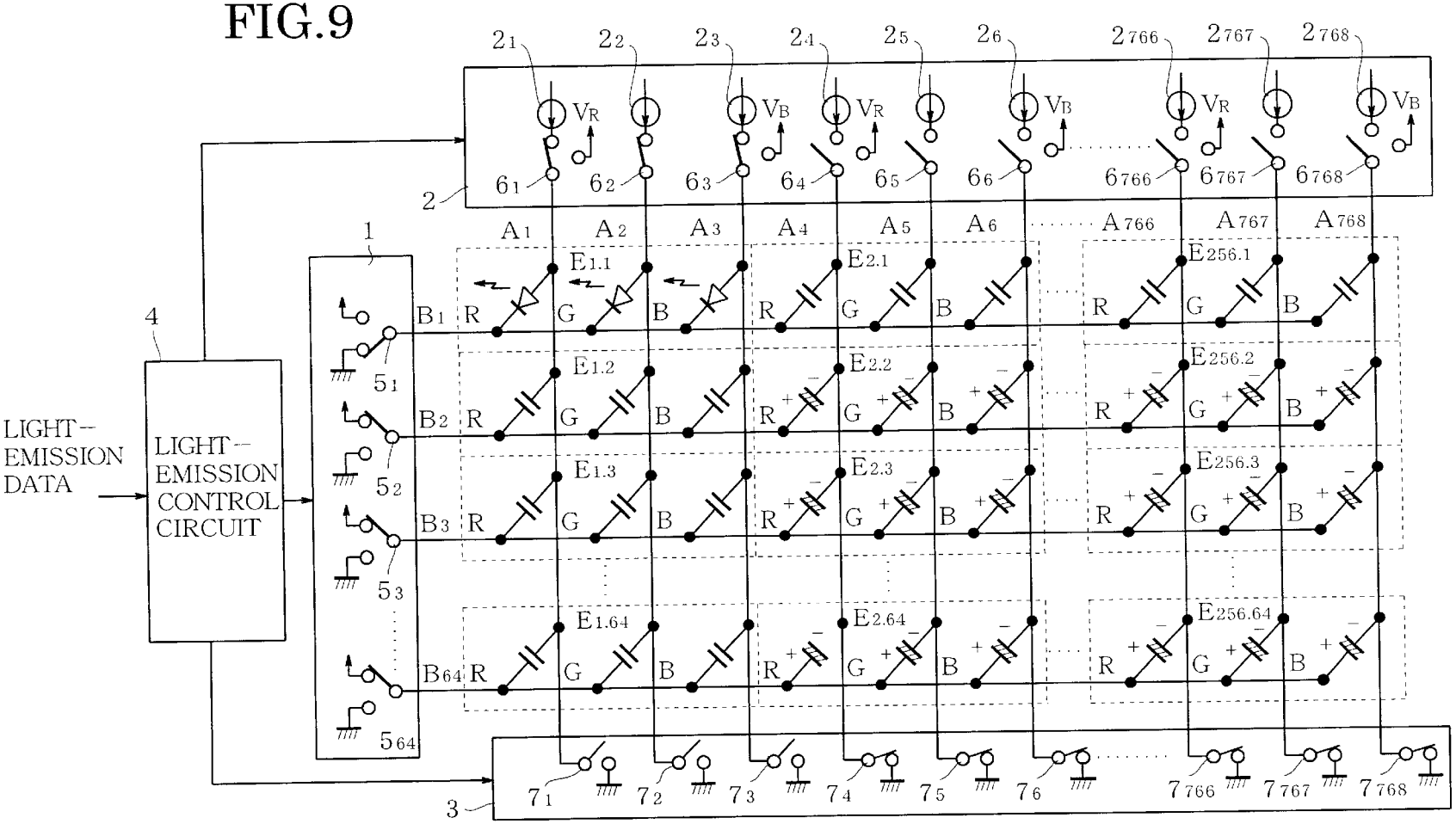
FIG. 9 is an explanatory diagram showing the electroluminescent display according to the second embodiment of the present invention under an operating condition.

FIG. 9 shows the state where the pixel $E_{1'1}$ is emitting light. Since this state is the same as that mentioned above in FIG. 5, the explanation of the state is omitted.

Figure 10:
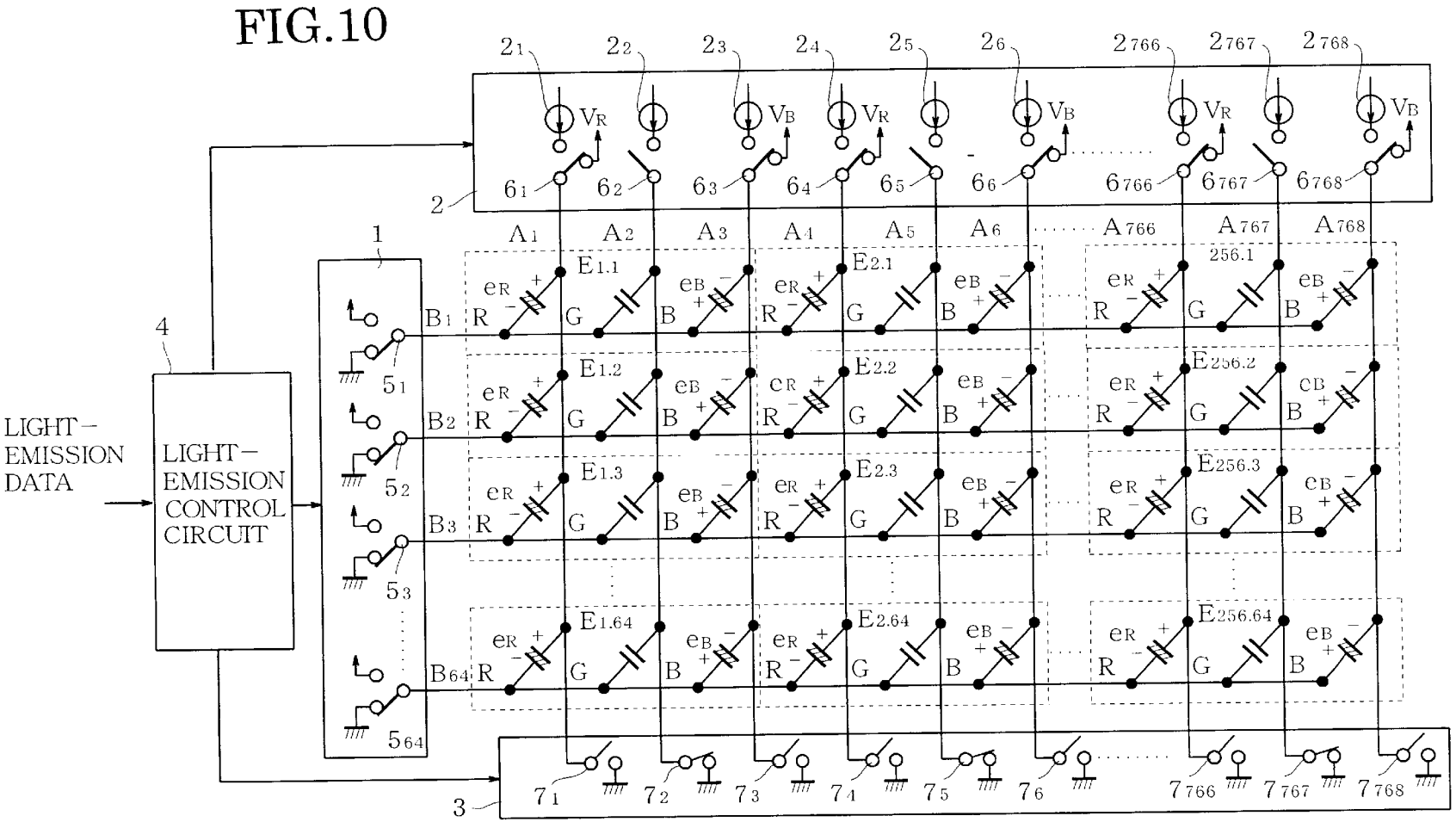
FIG. 10 is an explanatory diagram showing the electroluminescent display shown in FIG. 9 under an operating condition.

After the cathode line $B_1$ has been scanned and before the scan is switched to the cathode line $B_2$, reset operation is performed to charge all the light-emitting elements. That is, as shown in FIG. 10, all the scanning switches $\mathbf{5}_1$ to $\mathbf{5}_{64}$ are connected to the ground potential, and all the drive switches $\mathbf{6}_1$, $\mathbf{6}_4$, $\mathbf{6}_7$ . . . and $\mathbf{6}_3$, $\mathbf{6}_6$, $\mathbf{6}_9$ . . . are switched to the constant-voltage power supplies $V_R$ and $V_B$, respectively. All the drive switches $\mathbf{6}_2$, $\mathbf{6}_5$, $\mathbf{6}_8$ . . . , shunt switches $\mathbf{7}_1$, $\mathbf{7}_4$, $\mathbf{7}_7$ . . . and $\mathbf{7}_3$, $\mathbf{7}_6$, $\mathbf{7}_9$ . . . are made open, and shunt switched $\mathbf{7}_2$,$\mathbf{7}_5$, $\mathbf{7}_8$ . . . are turned ON.

Turning the switches as in the forgoing will cause the potential of all the cathode lines to become 0V, the potential of anode lines $A_1$, $A_4$, $A_7$ . . . to become $V_R$, anode lines $A_2$, $A_5$, $A_8$ . . . to become 0V, and anode lines $A_3$, $A_6$, $A_9$ . . . to become $V_B$. Consequently, as shown in FIG. 6, the parasitic capacitance of the light-emitting elements connected to anode lines $A_1$, $A_4$, $A_7$ . . . is charged so that the voltage across the both ends of the light-emitting elements becomes $V_R$ in the forward direction. Similarly, the light-emitting elements connected to anode lines $A_2$, $A_5$, $A_8$ . . . are charged by zero charge. The light-emitting elements connected to anode lines $A_3$, $A_6$, $A_9$ . . . are charged so that the voltage across the both ends of the light-emitting elements becomes $V_B$ in the reverse direction.

Figure 11:
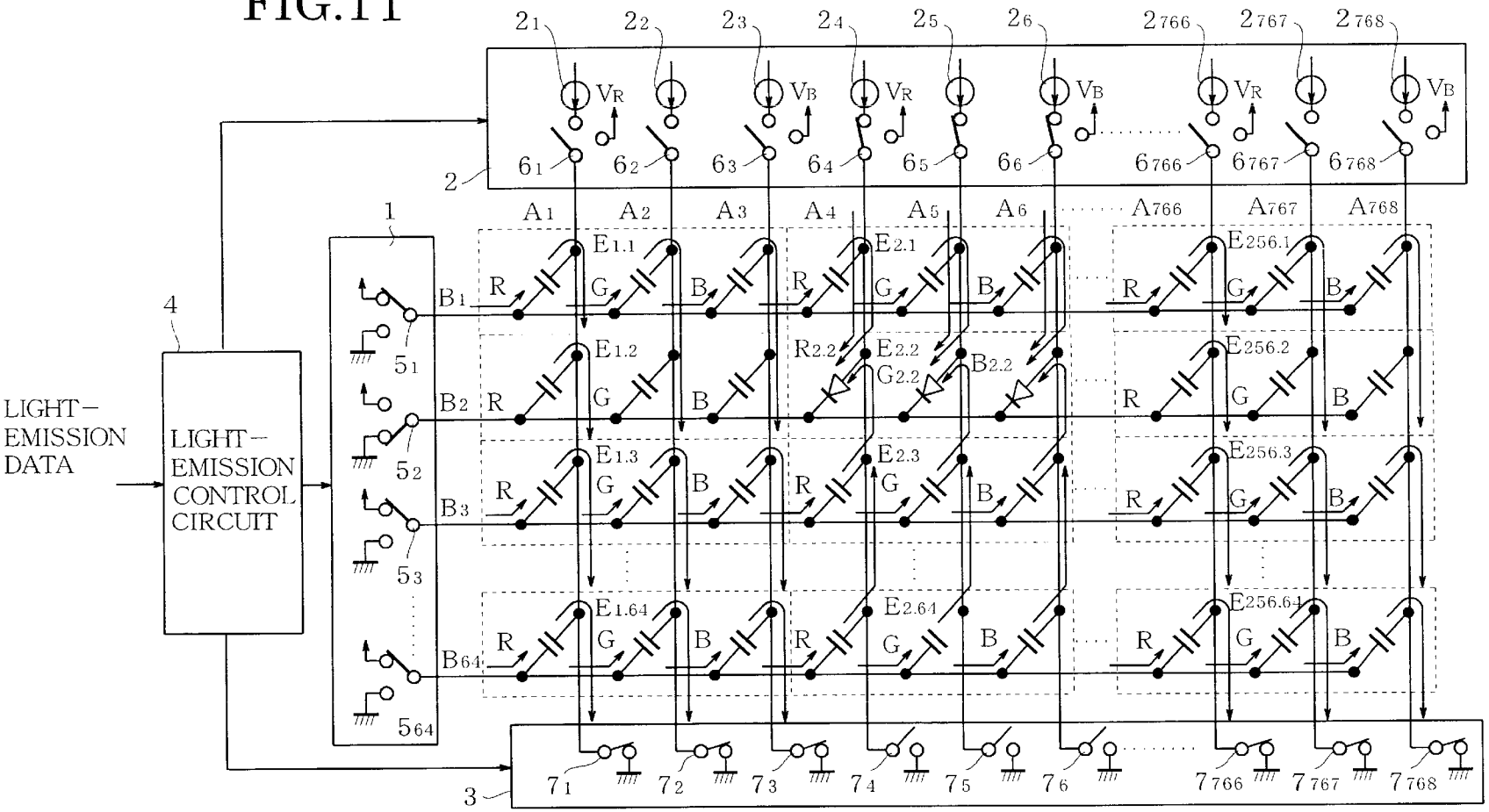
FIG. 11 is an explanatory diagram showing the electroluminescent display shown in FIG. 9 under another operating condition.

Then, the scan is moved to the cathode line $B_2$ as shown in FIG. 11. That is, only the scanning switch $\mathbf{5}_2$ corresponding to the cathode line $B_2$ is switched to the ground potential, while other scanning switches $\mathbf{5}_1$, $\mathbf{5}_3$ to $\mathbf{5}_{64}$ are switched to Vcc of the constant-voltage power supplies. Only drive switches $\mathbf{6}_4$ to $\mathbf{6}_6$ are switched to the constant-current power supplies $\mathbf{2}_4$ to $\mathbf{2}_6$. Thereby, the anode lines $A_4$ to $A_6$ are addressed, the shunt switches $\mathbf{7}_1$ to $\mathbf{7}_3$, $\mathbf{7}_7$ to $\mathbf{7}_{768}$ are turned ON, and the anode lines $A_1$ to $A_3$, and $A_7$ to $A_{768}$ become 0V in voltage.

In the moment switching is carried out as mentioned above, the anode line $A_4$ reaches approximately $Vcc+V_R$ (=Vr) in potential, and whereby the light-emitting element $R_{2'2}$ of the pixel $E_{2'2}$ will have at an instant a voltage of $Vcc+V_R$ across the both ends thereof. This causes a charge current to flow into the light-emitting element $R_{2'2}$ of the pixel $E_{2'2}$ over a path leading from the constant-current power supply $\mathbf{2}_4$ through the drive switch $\mathbf{6}_4$, the anode line $A_4$, and the light-emitting element $R_{2'2}$ to the scanning switch $\mathbf{5}_2$. As shown with arrows in FIG. 11, this also causes simultaneously another charge current to flow into the light-emitting element $R_{2'2}$ over a path leading from the scanning switch $\mathbf{5}_1$ through the cathode line $B_1$, the light-emitting element $R_{2'1}$ and the light-emitting element $R_{2'2}$ to the scanning switch $\mathbf{5}_2$. This also causes simultaneously other charge currents to flow into the light-emitting element $R_{2'2}$ over paths leading from, for example, the scanning switch $\mathbf{5}_{64}$ through the cathode line $B_{64}$ the light-emitting element $R_{2'64}$ and the light-emitting element $R_{2'2}$ to the scanning switch $\mathbf{5}_2$. The light-emitting element $R_{2'2}$ will be charged instantaneously by the plurality of charge currents and then built up to the state of emitting light at predetermined instantaneous luminance.

Similarly, the anode line $A_5$ will have at an instant a potential of Vcc and thus the light-emitting element $G_{2'2}$ will have a voltage of Vcc (=Vg) at an instant across the both sides thereof. This causes a charge current to flow into the light-emitting element $G_{2'2}$ over a path leading from the constant-current power supply $\mathbf{2}_5$ through the drive switch $\mathbf{6}_5$, the anode line $A_5$ and the light-emitting element $G_{2'2}$ to the scanning switch $\mathbf{5}_2$. As shown with arrows in FIG. 7, this also causes simultaneously another charge current to flow into the light-emitting element $G_{2'2}$ over a path leading from the scanning switch $\mathbf{5}_1$ through the cathode line $B_1$, the light-emitting element $G_{2'1}$, and the light-emitting element $G_{2'2}$ to the scanning switch $\mathbf{5}_2$. This also causes simultaneously other charge currents to flow into the light-emitting element $G_{2'2}$ over paths leading from, for example, the scanning switch $\mathbf{5}_{64}$ through the cathode line $B_{64}$, the light-emitting element $G_{2'64}$ and the light-emitting element $G_{2'2}$ to the scanning switch $\mathbf{5}_2$. The light-emitting element $G_{2'2}$ will be charged instantaneously by the plurality of charge currents.

Furthermore in a like manner, the anode line $A_6$ will have at an instant a potential of $Vcc+V_B$ and thus the light-emitting element $B_{2'2}$ will have a voltage of $Vcc+V_B$ (=Vb) at an instant across the both sides thereof. This causes a charge current to flow into the light-emitting element $B_{2'2}$ over a path leading from the constant-current power supply $\mathbf{2}_6$ through the drive switch $\mathbf{6}_6$, the anode line $A_6$, and the light-emitting element $B_{2'2}$ to the scanning switch $\mathbf{5}_2$. As shown with arrows in FIG. 11, this also causes simultaneously another charge current to flow into the light-emitting element $B_{2'2}$ over a path leading from the scanning switch $\mathbf{5}_1$ through the cathode line $B_1$, the light-emitting element $B_{2'1}$ and the light-emitting element $B_{2'2}$ to the scanning switch $\mathbf{5}_2$. This also causes simultaneously other charge currents to flow into the light-emitting element $B_{2'2}$ over paths leading from, for example, the scanning switch $\mathbf{5}_{64}$ through the cathode line $B_{64}$, the light-emitting element $B_{2'64}$ and the light-emitting element $B_{2'2}$ to the scanning switch $\mathbf{5}_2$. The light-emitting element $B_{2'2}$ will be charged instantaneously by the plurality of charge currents.

Figure 12:
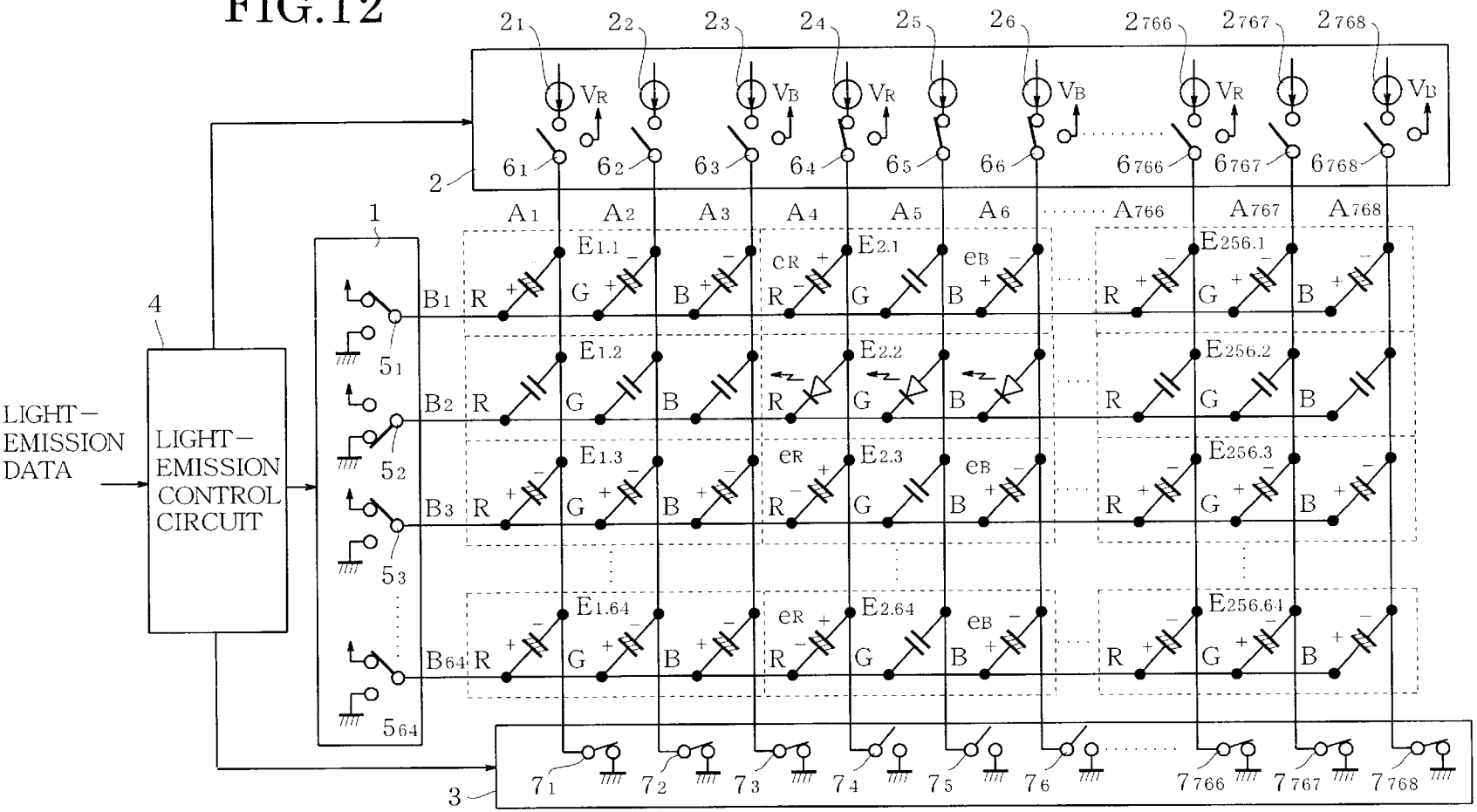
FIG. 12 is an explanatory diagram showing the electroluminescent display shown in FIG. 9 under still another operating condition.

Through the operations in the forgoing, the light-emitting elements $R_{2'2}$, $G_{2'2}$, $B_{2'2}$ of the pixels $E_{2'2}$ are charged at an instant to a voltage of $Vcc+V_R$, Vcc, and $Vcc+V_B$ respectively across the both ends thereof in the forward direction. Then, as shown in FIG. 12, the light emission will be sustained by means of driving current from the constant-current power supplies $\mathbf{2}_4$, $\mathbf{2}_5$ and $\mathbf{2}_6$ during the duration of scanning the cathode line $B_2$.

As mentioned above, when any one of the light-emitting elements of the three colors is emitting light at predetermined instantaneous luminance, the voltage across the both ends thereof (specified voltage) is set equal to the reverse bias voltage Vcc in the second embodiment of the present invention. Hereby, the constant-voltage power supplies can be reduced in number and thus the cost of the display device, compared with the first embodiment.

As mentioned above, the electroluminescent display of the present invention and the driving method theref or provide such a construction that allows each light-emitting element R, G, B to be charged by the amount of charge to the individual element when a scan is switched from one to another cathode line. Thereby, the light-emitting elements R, G, B are allowed to build up simultaneously to emit light at predetermined instantaneous luminance, and the accuracy of assigning weights to gradations is improved when addressed by the pulse-width modulation drive.

Although the present embodiment was explained through using light-emitting elements of the three colors of red, green and blue, the other colors may be used. Further, it is sufficient that light-emitting elements of two colors or more are used. In addition, the present invention may be applied to light-emitting elements also with charging voltage different from each other, even if they are the same colors of light-emitting elements.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. An electroluminescent display comprising:

a matrix of anode lines and cathode lines arranged so as to operate one of the anode and cathode lines as scanning lines and another as drive lines;

a plurality of light-emitting elements each having a color of two or more colors and being connected to an intersection of said scanning line and said drive line in such a manner that light-emitting elements having the same color are connected to said one drive line;

a power supply being connected to a predetermined drive line during the scanning of a scanning line in response to said scan on said scanning line, hereby causing a light emission by the light-emitting element connected to said intersection of said scanning line and said drive line; and a charging means for charging at least any one of said light-emitting elements in the duration between the end of a scan and the start of the subsequent scan, said charging means charging different amounts of charge to said light-emitting elements of different colors.

2. The electroluminescent display according to claim 1, wherein said charging means charges all of said light-emitting elements.

3. The electroluminescent display according to claim 1 or 2 wherein said each light-emitting element of a different color has a different specified voltage across the both ends thereof under steady light-emission conditions.

4. The electroluminescent display according to claim 3, wherein said light-emitting elements have one of three colors and said charging means is arranged in such a manner that an element of said light-emitting elements which has the highest value of said specified voltage is charged by a positive electric charge, an element of said light-emitting elements having the second highest value of said specified voltage is not charged, and an element of said light-emitting elements having the lowest value of said specified voltage is charged by a negative electric charge.

5. The electroluminescent display according claim 1 or 2, wherein said light-emitting elements are formed of organic electroluminescent materials.

6. The electroluminescent display according to claim 1, wherein said light-emitting elements has a combination of red, green and blue.

7. An electroluminescent display comprising:

a matrix of anode lines and cathode lines arranged so as to operate one of the anode and cathode lines as scanning lines and another as drive lines;

a plurality of light-emitting elements each having a color of two or more colors and being connected to an intersection of said scanning line and said drive line in such a manner that light-emitting elements having the same color are connected to said one drive line;

a power supply being connected to a predetermined drive line during the scanning of a scanning line in response to said scan on said scanning line, hereby causing a light emission by the light-emitting element connected to said intersection of said scanning line and said drive line;

a first constant-voltage power supply and a ground means, any one being connectable to said scanning line; and a second constant-voltage power supply for charging said light-emitting elements and a ground means, any one adding said power supply being connectable to said driving line;

wherein said ground means of said scanning line is connected to said scanning line, and said second constant-voltage power supply is connected to said driving line in the duration between the end of a scan and the start of the subsequent scan, and further said second constant-voltage power supply charges different amounts of charge to said light-emitting elements having different colors.

8. The electroluminescent display according to claim 7, wherein said each light-emitting element of a different color has a different specified voltage across the both ends thereof under steady light-emission conditions.

9. The electroluminescent display according to claim 7 or 8, wherein said second constant-voltage power supply is provided only for drive lines to which light-emitting elements having the highest value and the lowest value of said light-emission specified voltage among said two or more colors of light-emitting elements are connected, and further the light-emitting element having the highest value of said specified voltage is forward-biased, and the light-emitting element having the lowest value of said specified voltage is reverse-biased.

10. The electroluminescent display according claim 7 or 8, wherein in the scan period during which an arbitrary scanning line is being scanned, said ground means is connected to the scanning line which is being scanned, whereas said first constant-voltage power supply is connected to the scanning line which is not being scanned, and said power supply is connected to a drive line to which a light-emitting element to be emitting light is connected, whereas said ground means is connected to a drive line to which a light-emitting element not to be emitting light is connected.

11. The electroluminescent display according claim 7 or 8, wherein said light-emitting elements are formed of organic electroluminescent materials.

12. The electroluminescent display according to claim 7, wherein said light-emitting elements has a combination of red, green and blue.

13. A method of driving an electroluminescent display, comprising the steps of:

arranging a matrix of anode lines and cathode lines so as to operate one of the anode and cathode lines as scanning lines and another as drive lines;

connecting each of a plurality of light-emitting elements, each having a color of two or more colors, to an intersection of said scanning line and said drive line in such a manner that light-emitting elements having the same color are connected to said one drive line; and connecting a power supply to a predetermined drive line during the scanning of a scanning line in response to said scan on said scanning line, hereby causing a light emission by the light-emitting element connected to said intersection of said scanning line and said drive line, wherein different amounts of charge is charged to said each light-emitting element of a different color during the duration between the end of a scan and the start of the subsequent scan.

14. The method of driving an electroluminescent display according to claim 13, wherein during the duration between the end of a scan and the start of the subsequent scan, among three colors of light-emitting elements, positive electric charge is charged to a light-emitting element having the highest value of the light-emission specified voltage which is a voltage across the both ends thereof at the state of steady light emission, no electric charge is charged to a light-emitting element having the second highest value of said light-emission specified voltage, and negative electric charge is charged to a light-emitting element having the lowest value of said light-emission specified voltage.

15. The method of driving an electroluminescent display according to claim 13 or 14, wherein said light-emitting elements are formed of organic electroluminescent materials.

16. The method of driving an electroluminescent display according to claim 13, wherein said light-emitting elements has a combination of red, green and blue.

17. A method of driving an electroluminescent display, comprising the steps of:

arranging a matrix of anode lines and cathode lines so as to operate one of the anode and cathode lines as scanning lines and another as drive lines;

connecting each of a plurality of light-emitting elements, each having a color of two or more colors, to an intersection of said scanning line and said drive line in such a manner that light-emitting elements having the same color are connected to said one drive line; and connecting a power supply to a predetermined drive line during the scanning of a scanning line in response to said scan on said scanning line, hereby causing a light emission by the light-emitting element connected to said intersection of said scanning line and said drive line; characterized in that said scanning line is connectable to either of a first constant-voltage power supply or a ground means;

said drive line is connectable to any one of said power supply, a ground means, and a second constant-voltage power supply for charging said light-emitting elements;

said ground means is connected to the scanning line which is being scanned, whereas said first constant-voltage power supply is connected to the scanning line which is not being scanned, and said power supply is connected to a drive line to which a light-emitting element to be emitting light is connected, whereas said ground means is connected to a drive line to which a light-emitting element not to be emitting light is connected, in the can period during which an arbitrary scanning line is being scanned; and said ground means of said scanning line is connected to said scanning line, and said second constant-voltage power supply is connected to said driving line in the duration between the end of a scan and the start of the subsequent scan, and further said second constant-voltage power supply charges different amounts of charge to said each light-emitting element of a different color.

18. The method of driving an electroluminescent display according to claim 17, wherein said second voltage supply is provided only for drive lines to which light-emitting elements having the highest value and the lowest value of said light-emission specified voltage across the both ends thereof under steady light-emission conditions among said two or more colors of light-emitting elements are connected, and the light-emitting element having the highest value of said specified voltage is forward-biased and the light-emitting element having the lowest value of said specified voltage is reverse-biased.

19. The method of driving an electroluminescent display according to claim 17 or 18, wherein said light-emitting elements are formed of organic electroluminescent materials.

20. The method of driving an electroluminescent display according to claim 17, wherein said light-emitting elements has a combination of red, green and blue.

* * * * *